US008491779B2

(12) United States Patent
Shafi et al.

(10) Patent No.: US 8,491,779 B2
(45) Date of Patent: Jul. 23, 2013

(54) ALTERNATIVE PROCESS FOR TREATMENT OF HEAVY CRUDES IN A COKING REFINERY

(75) Inventors: Raheel Shafi, Dhahran (SA); Esam Z. Hamad, Dhahran (SA); Stephane Cyrille Kressmann, Dhahran (SA); Julio Hasselmeyer Moses, Dhahran (SA)

(73) Assignee: Saudi Arabian Oil Company (SA)

( * ) Notice: Subject to any disclaimer, the term of this patent is extended or adjusted under 35 U.S.C. 154(b) by 407 days.

(21) Appl. No.: 12/819,567

(22) Filed: Jun. 21, 2010

(65) Prior Publication Data

US 2011/0083996 A1 Apr. 14, 2011

Related U.S. Application Data

(60) Provisional application No. 61/219,156, filed on Jun. 22, 2009.

(51) Int. Cl.
*C10G 65/12* (2006.01)

(52) U.S. Cl.
USPC ..... 208/50; 208/125; 208/131; 208/132; 208/208 R; 208/209; 208/210; 208/211; 208/216 R; 208/217; 208/251 H; 208/251 R; 208/253

(58) Field of Classification Search
USPC ..... 208/49–50, 89, 208 R, 209–211, 208/216 R, 217, 251 H, 251 R, 253, 125, 208/131–132
See application file for complete search history.

(56) References Cited

U.S. PATENT DOCUMENTS

| | | | |
|---|---|---|---|
| 2,560,433 | A | 7/1951 | Gilbert et al. |
| 2,600,931 | A | 6/1952 | Slater |
| 2,646,388 | A | 7/1953 | Crawford et al. |
| 2,755,225 | A | 7/1956 | Porter et al. |
| 2,771,401 | A | 11/1956 | Shepherd |
| 2,909,476 | A | 10/1959 | Hemminger |
| 2,912,375 | A | 11/1959 | MacLaren |
| 2,939,835 | A | 6/1960 | Varga et al. |
| 3,119,765 | A | 1/1964 | Corneil et al. |

(Continued)

FOREIGN PATENT DOCUMENTS

| | | | |
|---|---|---|---|
| AU | 8544833 | A | 1/1986 |
| BE | 894513 | | 1/1983 |

(Continued)

OTHER PUBLICATIONS

Rana, M.S., Samano, V., Ancheyta, J. and Diaz, J.A.I., A Review of Recent Advances on Process Technologies for Upgrading of Heavy Oils and Residua, XP-002665558, www.sciencedirect.com, Sep. 7, 2006, pp. 1216-1321, vol. 86, Elsevier, Ltd. (2006).

(Continued)

*Primary Examiner* — Brian McCaig
(74) *Attorney, Agent, or Firm* — Bracewell & Giuliani LLP

(57) ABSTRACT

The present invention relates to a process for the pretreatment of heavy oils using a catalytic hydrotreating process prior to introduction to a refinery. More specifically, the invention relates to the use of an HDM reactor and an HDS reactor in order to improve the characteristics of the heavy oil, such that when the oil is introduced into the refinery, the refinery can achieve improved throughputs, increased catalysts life, increased life cycles, and a reduction in overall operation costs.

14 Claims, 3 Drawing Sheets

U.S. PATENT DOCUMENTS

| | | | | |
|---|---|---|---|---|
| 3,262,874 | A | | 7/1966 | Gatsis |
| 3,501,396 | A | | 3/1970 | Gatsis et al. |
| 3,617,524 | A | | 11/1971 | Conn |
| 3,623,974 | A | | 11/1971 | Mounce |
| 3,684,688 | A | | 8/1972 | Roselius |
| 3,686,093 | A | | 8/1972 | Irvine |
| 3,694,351 | A | | 9/1972 | White |
| 3,706,657 | A | | 12/1972 | Paraskos et al. |
| 3,730,879 | A | | 5/1973 | Christman et al. |
| 3,730,880 | A | | 5/1973 | Van der Toorn et al. |
| 3,773,653 | A | * | 11/1973 | Nongbri et al. ..... 208/50 |
| 3,787,315 | A | | 1/1974 | Bearden, Jr. et al. |
| 3,806,444 | A | | 4/1974 | Crouch et al. |
| 3,809,644 | A | | 5/1974 | Johnson et al. |
| 3,826,737 | A | | 7/1974 | Pegels et al. |
| 3,876,530 | A | | 4/1975 | Frayer et al. |
| 3,876,533 | A | | 4/1975 | Myers |
| 3,887,455 | A | | 6/1975 | Hamner et al. |
| 3,901,792 | A | | 8/1975 | Wolk et al. |
| 3,915,841 | A | | 10/1975 | Murphy, Jr. et al. |
| 3,926,784 | A | | 12/1975 | Christman et al. |
| 3,957,622 | A | | 5/1976 | Gatsis et al. |
| 3,976,559 | A | | 8/1976 | Bearden, Jr. et al. |
| 4,003,823 | A | | 1/1977 | Baird, Jr. et al. |
| 4,003,824 | A | | 1/1977 | Baird, Jr. et al. |
| 4,006,076 | A | | 2/1977 | Christensen et al. |
| 4,007,109 | A | | 2/1977 | Baird, Jr. et al. |
| 4,007,111 | A | | 2/1977 | Baird, Jr. |
| 4,017,381 | A | | 4/1977 | Baird, Jr. et al. |
| 4,017,382 | A | | 4/1977 | Bonnell et al. |
| 4,045,182 | A | | 8/1977 | Bonnell |
| 4,045,331 | A | | 8/1977 | Ward |
| 4,048,060 | A | | 9/1977 | Riley |
| 4,052,295 | A | | 10/1977 | Pronk |
| 4,076,613 | A | | 2/1978 | Bearden, Jr. |
| 4,089,774 | A | | 5/1978 | Oleck et al. |
| 4,118,310 | A | | 10/1978 | Frayer et al. |
| 4,119,528 | A | | 10/1978 | Baird, Jr. et al. |
| 4,120,779 | A | | 10/1978 | Baird, Jr. et al. |
| 4,120,780 | A | | 10/1978 | Morimoto et al. |
| 4,234,402 | A | | 11/1980 | Kirkbride |
| 4,259,294 | A | | 3/1981 | Van Zijll Langhout et al. |
| 4,332,671 | A | | 6/1982 | Boyer |
| 4,348,270 | A | | 9/1982 | Bearden, Jr. et al. |
| 4,406,777 | A | | 9/1983 | Melconian |
| 4,411,768 | A | | 10/1983 | Unger et al. |
| 4,431,525 | A | | 2/1984 | Hensley, Jr. et al. |
| 4,431,526 | A | | 2/1984 | Simpson et al. |
| 4,568,450 | A | | 2/1986 | Ting et al. |
| 4,588,709 | A | | 5/1986 | Morales et al. |
| 4,617,110 | A | | 10/1986 | Hinojos et al. |
| 4,619,759 | A | | 10/1986 | Myers et al. |
| 4,626,340 | A | | 12/1986 | Galiasso et al. |
| 4,642,179 | A | | 2/1987 | Morales et al. |
| 4,652,361 | A | | 3/1987 | Kukes et al. |
| 4,657,665 | A | | 4/1987 | Beaton et al. |
| 4,729,826 | A | | 3/1988 | Lindsay et al. |
| 4,832,829 | A | | 5/1989 | de Agudelo et al. |
| 4,894,144 | A | | 1/1990 | Newman et al. |
| 4,925,554 | A | | 5/1990 | Sato et al. |
| 4,968,409 | A | | 11/1990 | Smith |
| 5,009,768 | A | | 4/1991 | Galiasso et al. |
| 5,045,177 | A | | 9/1991 | Cooper et al. |
| 5,076,908 | A | | 12/1991 | Stangeland et al. |
| 5,176,820 | A | | 1/1993 | Lew |
| 5,178,749 | A | | 1/1993 | Lopez et al. |
| 5,258,115 | A | | 11/1993 | Heck et al. |
| 5,264,188 | A | | 11/1993 | Lew |
| 5,286,371 | A | | 2/1994 | Goval et al. |
| 5,417,846 | A | | 5/1995 | Renard |
| 5,591,325 | A | | 1/1997 | Higashi |
| 5,779,992 | A | | 7/1998 | Higashi |
| 5,916,529 | A | | 6/1999 | Scheuerman |
| 5,925,238 | A | | 7/1999 | Duddy et al. |
| 6,132,597 | A | | 10/2000 | Harle et al. |
| 6,235,190 | B1 | | 5/2001 | Bertram |
| 6,270,654 | B1 | | 8/2001 | Colyar et al. |
| 6,280,606 | B1 | | 8/2001 | Morel et al. |
| 6,306,287 | B1 | | 10/2001 | Billon et al. |
| 6,309,537 | B1 | | 10/2001 | Harle et al. |
| 6,447,671 | B1 | | 9/2002 | Morel et al. |
| 6,554,994 | B1 | | 4/2003 | Reynolds et al. |
| 6,620,311 | B2 | | 9/2003 | Morel et al. |
| 7,291,257 | B2 | | 11/2007 | Ackerson et al. |
| 2001/0027936 | A1 | | 10/2001 | Morel et al. |
| 2003/0173256 | A1 | * | 9/2003 | Fujikawa et al. ..... 208/217 |
| 2004/0055934 | A1 | | 3/2004 | Tromeur et al. |
| 2005/0082202 | A1 | | 4/2005 | Ackerson et al. |
| 2005/0109674 | A1 | * | 5/2005 | Klein ..... 208/111.3 |
| 2005/0155909 | A1 | | 7/2005 | Inomata et al. |
| 2006/0060501 | A1 | | 3/2006 | Gauthier et al. |
| 2006/0060509 | A1 | | 3/2006 | Miyauchi et al. |
| 2006/0254956 | A1 | | 11/2006 | Khan |
| 2007/0187294 | A1 | | 8/2007 | Ancheyta Juarez et al. |
| 2008/0289999 | A1 | | 11/2008 | Lenglet |

FOREIGN PATENT DOCUMENTS

| | | | |
|---|---|---|---|
| DE | 2138853 | A | 8/1974 |
| DE | 2655260 | A1 | 6/1977 |
| EP | 0 041 588 | A1 | 12/1981 |
| EP | 0113283 | B1 | 7/1984 |
| EP | 0113297 | B1 | 7/1984 |
| EP | 0450997 | B1 | 10/1991 |
| EP | 0732389 | B1 | 8/2001 |
| EP | 1600491 | A1 | 11/2005 |
| EP | 1652905 | A | 5/2006 |
| FR | 2415136 | A | 8/1979 |
| FR | 2681871 | A1 | 4/1993 |
| FR | 2784687 | A1 | 4/2000 |
| GB | 438354 | | 4/1934 |
| GB | 710342 | | 9/1950 |
| GB | 744159 | | 7/1953 |
| GB | 0721357 | | 1/1955 |
| GB | 830923 | | 3/1956 |
| GB | 786451 | | 11/1957 |
| GB | 1073728 | | 7/1964 |
| GB | 1181982 | | 6/1967 |
| GB | 1335348 | | 2/1970 |
| GB | 1523992 | | 9/1978 |
| GB | 2026533 | A | 2/1980 |
| GB | 2066287 | A | 7/1981 |
| GB | 2124252 | A | 2/1984 |
| GB | 2150852 | A | 12/1984 |
| JP | 71034507 | B | 7/1968 |
| JP | 49015703 | A | 2/1974 |
| JP | 49051303 | A | 5/1974 |
| JP | 74037085 | B | 10/1974 |
| JP | 48054105 | A | 10/1975 |
| JP | 76038722 | B | 10/1976 |
| JP | 60065093 | A | 4/1985 |
| JP | 2000265177 | A | 3/1999 |
| NL | 6916017 | A | 4/1970 |
| NL | 7213105 | | 9/1972 |
| NL | 7115994 | A | 9/1974 |
| NL | 7117302 | A | 10/1974 |
| RU | 2074883 | C1 | 3/1997 |
| WO | 0198436 | A1 | 12/2001 |
| WO | 2004078889 | A1 | 9/2004 |
| WO | 2006039429 | A | 4/2006 |
| WO | 2006114489 | A1 | 11/2006 |
| WO | 2009073436 | A2 | 6/2009 |

OTHER PUBLICATIONS

PCT International Search Report dated Jan. 2, 2012, International Application No. PCT/US2010/039332, International Filing date Jun. 21, 2010.

* cited by examiner

ALTERNATIVE PROCESS FOR TREATMENT OF HEAVY CRUDES IN A COKING REFINERY

RELATED APPLICATIONS

This patent application claims priority to U.S. Provisional Patent Application Ser. No. 61/219,156 filed on Jun. 22, 2009, which is incorporated by reference in its entirety.

BACKGROUND OF THE INVENTION

1. Field of the Invention

The present invention relates to a process for the treatment of heavy oils, including crude oils, vacuum residue, tar sands, bitumen and vacuum gas oils using a catalytic hydrotreating pretreatment process. More specifically, the invention relates to the use of hydrodemetallization (HDM) and hydrodesulfurization (HDS) catalysts in series in order to improve the efficiency of a subsequent coker refinery.

2. Description of the Related Art

Hydrotreating is useful for the purpose of improving heavy oils. The improvement can be evidenced as the reduction of sulfur content of the heavy oil, an increase in the API gravity of the heavy oil, a significant reduction in the metal content of the heavy oil, or a combination of these effects.

The availability of light sweet crudes is expected to diminish in the future as the production of oil becomes increasingly difficult and greater reliance is placed on tertiary and other enhanced recovery techniques. Heavier crudes and sour crudes will take on greater importance in overall hydrocarbon production and the upgrading of such crudes into fuels will become increasingly important. So called heavier crudes contain a larger proportion of heavy and sour material such as high boiling vacuum residue fractions. In addition to the decreasing quality of the crudes and their derived heavy oils, specifications for on-road and off-road fuel will become increasingly more stringent due to environmental legislation around the world. These heavy crudes require deep conversion and refining into lighter and cleaner components through costly techniques, which normally employ high pressures and temperatures.

These conversion techniques compete in terms of their associated capital expenditure and operational expenditure and can range from hydroconversion, such as high pressure ebullating bed conversion to thermal techniques, such as delayed coking. In the case of each, their integration into the refinery can be a costly addition and generally the lower the API of the crude oil, the more constrained the unit will be due to higher associated metals, asphaltene, sulfur and nitrogen. Any technology, method or refinery flow scheme to help increase the profitability of such process units, and therefore, upgrading techniques will prove a significant enabler for the refiner; allowing the processing of heavier and/or sourer crudes, and therefore, positively impacting the upgrading margin.

One of the main limiting factors for hydrotreating units is catalyst deactivation. As the heavy oil feedstock being treated becomes heavier, i.e. has a lower API Gravity, the complexity of the molecules increases. This increase in complexity is both in the molecular weight and also in the degree of unsaturated components. Both of these effects increase the coking tendency of the feedstock, which is one of the main mechanisms of deactivation of the catalyst.

Another aspect of the feedstock leading to deactivation of catalyst is metal content present in the heavy crude. These metals are normally present in the form of porphyrin type structures and they often contain nickel and/or vanadium, which have a significant deactivating effect on the catalyst. Similar to coking tendency, the metal concentration of the heavy oil feedstream increases with decreasing API gravity.

Pre-refining of crude oil would provide a significant advantage for downstream process units. In particular, the removal of metals as well as reduction of aromatics and the removal of sulfur would substantially improve the performance of subsequent coking units.

As the refining industry increasingly processes high sulfur, low API crudes, catalyst deactivation will become a critical path problem, thereby decreasing the on-stream cycle length and therefore increasing the cost of processing, which negatively impacts process profitability. Advances in the treatment of heavy oil with respect to a reduction in catalyst deactivation will therefore be of paramount importance to the refining industry in future years.

In addition to the above challenges, global diesel demand is forecasted to increase in the coming years due to the dieselization trend, equaling global demand for gasoline in the near future and surpassing this demand thereafter. The inherent content of the gas oil in crude oils is limited, and conventional, conversion techniques, such as hydrocracking, that are used to increase the diesel yield by conversion are expensive. There is a need to provide a process for heavy oils that will increase diesel production in a cost-effective manner to meet market demands.

SUMMARY OF THE INVENTION

The present invention is directed to a process that satisfies at least one of these needs. The current invention aims to provide a lighter, cleaner feedstock for such a refinery with a delayed coker for bottoms conversion. The present invention is applicable for a wide variety of heavy crude oils, one of them being Arab Heavy. The typical properties for an Arab Heavy crude oil can be seen in Table I below.

TABLE I

Arab Heavy Export Feedstock

| Analysis | Units | Value |
|---|---|---|
| API | Degree | 27 |
| Density | | 0.8904 |
| Sulfur Content | wt % | 2.83 |
| Nickel | ppmw | 16.4 |
| Vanadium | ppmw | 56.4 |
| NaCl Content | ppmw | <5 |
| Conradson Carbon Residue (CCR) | wt % | 8.2 |
| $C_5$ Asphaltenes | wt % | 7.8 |
| $C_7$ Asphaltenes | wt % | 4.2 |

In an embodiment of the invention, the process includes two segments, the first is a pre-treatment segment to reduce the sulfur and contaminants in the whole crude oil followed by a second segment whereby the crude from the pretreatment step is further treated in a refinery.

The present invention describes a process for the upgrading of a heavy oil feed stream, non-limiting examples of which include vacuum residue, whole crude oil, atmospheric residue and bitumen as well as other heavy oils.

In one embodiment of the invention, the process for improving throughputs of a refinery includes introducing a virgin crude oil stream, which can include whole crude oil, in the presence of hydrogen gas to a hydrodemetallization (HDM) reaction zone, wherein the HDM reaction zone has a weighted average bed temperature (WABT) of about 350 to about 450 degrees Celsius, preferably 370 to 415 degrees Celsius, and at a pressure of between 30-200 bars, preferably 100 bars. The HDM reaction zone contains an HDM catalyst, with the HDM catalyst being operable to remove a substantial quantity of metal compounds from the virgin crude oil stream resulting in a combined effluent stream. In one embodiment, the HDM catalyst includes a metal sulfide on a support material, wherein the metal is selected from the group consisting of Group Va, VIa, VIII of the periodic table, and combinations thereof. The support material can be γ-alumina or silica/alumina extrudates, spheres, cylinders, beads and pellets. The shape is generally extrudates; however, alumina beads can be used advantageously to improve the un-loading of the HDM catalyst beds in the HDM reactor, since the metals uptake can be from 30 to 100% at the top of the bed.

In one embodiment, the HDM catalyst are generally based on a gamma alumina support, with a surface area of around 100-160 $m^2/g$. The HDM catalyst can be best described as having a very high pore volume, in excess of 0.8 $cm^3/g$. The pore size itself is typically predominantly macroporous. This advantageously provides a large capacity for the uptake of metals on the HDM catalyst's surface and optionally dopants. In embodiments in which the active metals on the HDM catalyst surface are sulfides of Nickel and Molybdenum, the HDM catalyst preferably has a Nickel to Molybdenum mole ratio (Ni/(Ni+Mo)) of less than 0.15. The concentration of Nickel can be lower on the HDM catalyst than other catalysts as some Nickel and Vanadium will likely be deposited from the feedstock itself, and thereby acting as additional catalyst. In one embodiment, the dopant can be selected from the group consisting of boron, silicon, halogens, phosphorus, and combinations thereof. Phosphorus is the preferred dopant.

The process can further include removing the combined effluent stream from the HDM reaction zone and introducing the combined effluent stream to a hydrodesulfurization (HDS) reaction zone. The HDS reaction zone has a weighted average bed temperature (WABT) of approximately 370 to 410 degrees Celsius. In one embodiment, the HDS reaction zone contains an HDS catalyst, with the HDS catalyst being operable to remove a substantial quantity of sulfur components from the combined effluent stream resulting in an HDS effluent stream. In one embodiment, a substantial quantity of sulfur is at least 30% by weight. In one embodiment, the HDS catalyst includes a metal sulfide on a support material, wherein the metal is selected from the group consisting of Group Va, VIa, VIII of the periodic table, and combinations thereof. The support material can be γ-alumina and silica extrudates, spheres, cylinders and pellets.

Preferably, the HDS catalyst contains a gamma alumina based support and a surface area of approximately 180-240 $m^2/g$. This increased surface area for the HDS catalyst allows for a smaller pore volume (less than 1.0 $cm^3/g$). In one embodiment, the HDS catalyst contains at least one metal from Group VI, preferably molybdenum and at least one metal from Group VIII, preferably nickel. The HDS catalyst can also include at least one dopant selected from the group consisting of boron, phosphorus, silicon, halogens, and combinations thereof. In one embodiment, cobalt can be used to increase desulfurization of the HDS catalyst. In one embodiment, the HDS catalyst has a higher metals loading for the active phase as compared to the HDM catalyst. This increased metals loading helps to meet the increased activity. Preferably, the HDS catalyst has a Nickel to Molybdenum mole ratio (Ni/(Ni+Mo)) of 0.1 to 0.3. In an embodiment that includes cobalt, the mole ratio of (Co+Ni)/Mo can be in the range of 0.25 to 0.85.

The HDS effluent stream is then removed from the HDS reaction zone and can be fed into a separation unit, where the HDS effluent stream is separated into a process gas component stream and an intermediate liquid product. The intermediate liquid product contains reduced amounts of sulfur, metals, and Conradson carbon as compared to the virgin crude oil stream. Additionally, the intermediate liquid product has an increased API gravity as compared to the virgin crude oil stream. In one embodiment, at least a portion of the gas component stream is recycled to the HDM reaction zone. Furthermore, an embodiment can also include introducing the intermediate liquid product from the separation unit into a delayed coking facility to produce a final liquid product, such that the final product has an increased diesel content as compared to the virgin crude oil stream, wherein the delayed coking facility's throughput has at least a 10 percent increase when using the intermediate liquid product as opposed to the virgin crude oil stream.

In another embodiment, the process can also include a hydrodemetallization/hydrodesulfurization (HDM/HDS) reaction zone. The HDM/HDS reaction zone can be located in between the HDM reaction zone and the HDS reaction zone. In such an embodiment, the process can further include removing the combined effluent stream from the HDM reaction zone and introducing the combined effluent stream to the HDM/HDS reaction zone. The HDM/HDS reaction zone has a weighted average bed temperature (WABT) of about 370 to about 410 degrees Celsius.

In one embodiment, the HDM/HDS reaction zone contains an HDM/HDS catalyst, with the HDM/HDS catalyst being operable to remove a quantity of metal components and a quantity of sulfur components from the combined effluent stream resulting in an HDM/HDS effluent stream. The HDM/HDS effluent stream can then be introduced into the HDS reaction zone. The HDM/HDS catalyst is preferably an alumina based support in the form of extrudates. In one embodiment, the HDM/HDS catalyst has one metal from Group VI and one metal from Group VIII. Preferred Group VI metals include molybdenum and tungsten, with molybdenum being most preferred. Preferred Group VIII metals include nickel, cobalt, and combinations thereof. The HDM/HDS catalyst can also contain a dopant that is selected from the group consisting of boron, phosphorus, halogens, silicon, and combinations thereof. The HDM/HDS catalyst can have a surface area of approximately 140-200 $m^2/g$. The HDM/HDS catalyst can have an intermediate pore volume of approximately 0.6 $cm^3/g$. The HDM/HDS catalyst is preferably a mesoporous structure having pore sizes in the range of 12 to 50 nm. These characteristics provide a balanced activity in HDM and HDS.

In an alternate embodiment, the process can also include a hydroconversion (HDC) reaction zone. Prior to introducing the HDS effluent stream to a refinery, the HDS effluent stream can be introduced into an HDC reaction zone. The HDC reaction zone contains an HDC catalyst that is operable to crack the HDS effluent stream resulting in a cracked HDS effluent stream. The HDC catalyst can be a zeolite based catalyst or modified zeolite based catalyst. Preferably the HDC catalyst has a metal function that is a sulfide formed in situ, and an oxide formed ex-situ. The surface area of the HDC catalyst is generally higher than the HDM, HDM/HDS, and HDS catalysts, although there can be some overlap in the ranges. In part, the HDC catalyst can have an amorphous material that can act as a binder for the zeolite. Non-limiting examples of the amorphous material are γ-alumina and amorphous silica aluminas. The HDC catalyst can include the following materials: zeolite Beta, AWLZ-15, LZ-45, Y-82, Y-84, LZ-210, LZ-25, Silicalite, mordenite.

In one embodiment, a steam pretreatment of the highly acidic materials can be employed. the HDC catalyst can be selected from the group consisting of sulfides of the Group Va, VIa and VIIIa metals on an inorganic oxide support, wherein the inorganic oxide support is selected from the group consisting of alumina, silica alumina, a zeolite, and combinations thereof. The HDC catalyst can preferably be in the form of extrudates, spheres, cylinders, pellets, and combinations thereof. Preferred metals include Nickel and Molybdenum.

The cracked HDS effluent stream is characterized as having an increased API gravity of at least about 1° greater than the virgin crude oil and a reduced amount of metal and sulfur content as compared to the virgin crude oil. The cracked HDS effluent stream can then be fed to the separation unit in a similar fashion as the HDS effluent stream.

BRIEF DESCRIPTION OF THE DRAWINGS

So that the manner in which the above-recited features, aspects and advantages of the invention, as well as others that will become apparent, are attained and can be understood in detail, more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF EMBODIMENTS OF THE PRESENT INVENTION

Figure 1:
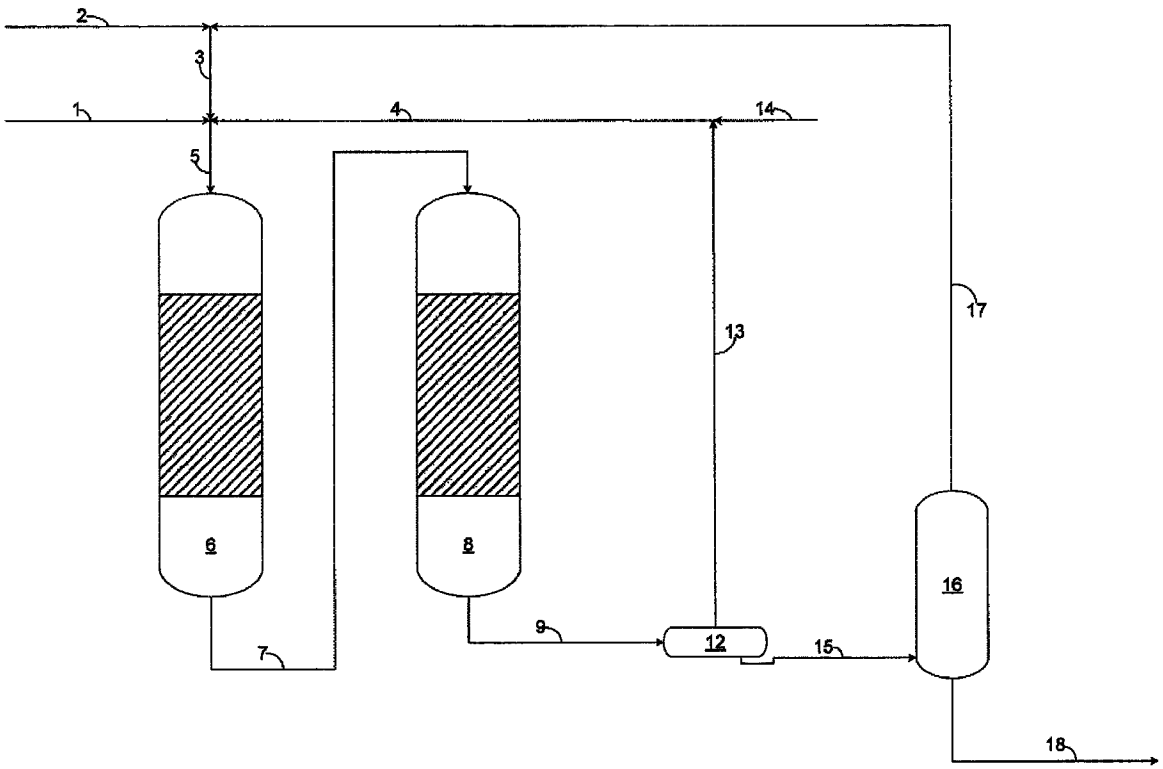
FIG. 1 shows a pretreatment step in accordance with an embodiment of the present invention.

FIG. 1 shows an exemplary embodiment for the pretreatment step of the current invention. In FIG. 1, heavy oil feed stream (1) is mixed with hydrogen source (4). Hydrogen source (4) can be derived from recycle of process gas component stream (13), including unspent process hydrogen gas, and/or from fresh make-up hydrogen stream (14) to create first input stream (5). In one embodiment, first input stream (5) is heated to a process temperature of between 350 and 450° C. First input stream (5) enters into hydrodemetallization reaction zone (6), containing hydrodemetallization catalyst, to remove a substantial quantity of metal compounds present in first input stream (5). Combined effluent stream (7) exits hydrodemetallization reaction zone (6) and is fed to HDS reaction zone (8) containing HDS catalyst to produce HDS effluent (9). A substantial amount of sulfur in combined effluent stream (7) is removed through hydrodesulfurization to produce HDS effluent (9). HDS effluent (9) has a reduced API gravity in comparison with heavy oil feed stream (1) and a significantly increased diesel content.

HDS effluent (9) enters separation unit (12) and is separated into process gas component stream (13) and intermediate liquid product (15). In one embodiment, HAS effluent (9) is also purified to remove hydrogen sulfide and other process gases to increase the purity of the hydrogen to be recycled in process gas component stream (13). The hydrogen consumed in the process can be compensated for by the addition of a fresh hydrogen from fresh make-up hydrogen stream (14), which can be derived from a steam or naphtha reformer or other source. Process gas component stream (13) and fresh make-up hydrogen stream (14) combine to form hydrogen source (4) for the process. In one embodiment, intermediate liquid product (15) from the process can be flashed in flash vessel (16) to separate light hydrocarbon fraction (17) and final liquid product (18); however, this flashing step is not a requirement. In one embodiment, light hydrocarbon fraction (17) acts as a recycle and is mixed with fresh light hydrocarbon diluent stream (2) to create light hydrocarbon diluent stream (3). Fresh light hydrocarbon diluent stream (2) can be used to provide make-up diluent to the process as needed in order to help further reduce the deactivation of the HDM catalyst and the HDS catalyst.

Final liquid product (18) has significantly reduced sulfur, metal, asphaltenes, Conradson carbon and nitrogen content as well as an increased API and increased diesel and vacuum distillate yields in comparison with the feed stream. Typical properties for final liquid product (18), also termed "sweetened crude oil" herein, can be seen in Table II below, with the values for heavy oil feed stream (1), also termed as "virgin crude oil" herein, being in parenthesis. In embodiments not employing the flashing step, intermediate liquid product (15) can also be considered to be "sweetened crude oil" herein.

TABLE II

Comparison of Sweetened Crude Oil and Virgin Crude Oil

| | $C_1$-$C_4$ | $C_5$-85° C. | 85-150° C. | 150-250° C. | 250-350° C. | 350-540° C. | 540° C.+ | WCO |
|---|---|---|---|---|---|---|---|---|
| Yield | 1.09 | 4.2 | 7.11 | 15.44 | 17.62 | 29.86 | 24.67 | 100 |
| (wt %) | (1) | (4.62) | (7.16) | (15.86) | (11.89) | (25.99) | (33.48) | (100) |
| Conradson Carbon (MCRT) | | | | | | 0.32 | 17.74 | 4.97 |
| wt % | | | | | | (0.1) | (25.1) | (8.2) |
| Nickel | | | | | | <0.5 | 35.8 | 8.6 |
| (ppmw) | | | | | | (<2) | (53.1) | (16.4) |
| Vanadium | | | | | | <0.5 | 86.9 | 23.4 |
| (ppmw) | | | | | | (<2) | (175.9) | (56.4) |
| $C_5$ Asphaltenes | | | | | | | 15.3 | 3.92 |
| (wt %) | | | | | | | (24) | (7.8) |
| $C_7$ Asphaltenes | | | | | | | 10.5 | 2.69 |
| | | | | | | | (13.8) | (4.2) |

TABLE II-continued

| Comparison of Sweetened Crude Oil and Virgin Crude Oil | | | | | | | | |
|---|---|---|---|---|---|---|---|---|
| | $C_1$-$C_4$ | $C_5$-85° C. | 85-150° C. | 150-250° C. | 250-350° C. | 350-540° C. | 540° C.+ | WCO |
| (wt %) | | | | | | | | |
| Density | | 0.686 (0.659) | 0.7334 (0.728) | 0.7935 (0.7977) | 0.8472 (0.8586) | 0.8908 (0.9266) | 0.995 (1.043) | 0.8754 (0.91) |
| Cetane number | | | | 47.4 (49.44) | 53.9 (55.1) | | | |
| Sulfur (wt %) | | <0.0010 (0.0005) | <0.0010 (0.0118) | <0.0010 (0.356) | 0.0345 (1.683) | 0.1735 (2.946) | 1.7201 (5.477) | 0.563 (2.8297) |
| Saturates (SARA) | | | | | | 54.5 (42.6) | 13.8 (6.2) | |
| Aromatics (SARA) | | | | | | 42.4 (52.1) | 47.7 (36.6) | |
| Resins (SARA) | | | | | | 1.6 (4.9) | 24.6 (39.4) | |
| Asphaltenes (SARA) | | | | | | | 12.8 (15.8) | |
| Aniline point (° C.) | | | | | | 82.5 (—) | | |
| Viscosity @257° F. (cSt) | | | | | | | 356 (2111) | |
| Viscosity @212° F. (cSt) | | | | | | 7.8 (1.7) | 1400 (11965) | |

Without being bound to any theory, it is believe that during the HDM reaction, porphyrin type compounds present in the virgin crude oil are first hydrogenated by the catalyst using hydrogen to create an intermediate. Following this primary hydrogenation, the Nickel or Vanadium present in the center of the porphyrin molecule is reduced with hydrogen and then further to the corresponding sulfide with $H_2S$. The final metal sulfide is deposited on the catalyst thus removing the metal sulfide from the virgin crude oil. Sulfur is also removed from sulfur containing organic compounds. This is performed through a parallel pathway. The rates of these parallel reactions depend upon the sulfur species being considered. Overall, hydrogen is used to abstract the sulfur which is converted to $H_2S$ in the process. The remaining, sulfur-free hydrocarbon fragment remains in the liquid hydrocarbon stream.

In a similar manner, and again not intending to be bound to any theory, hydrodenitrogenation and hydrodearomatisation operate via related reaction mechanisms. Both involve some degree of hydrogenation. For the hydrodenitrogenation, organic nitrogen compounds are usually in the form of heterocyclic structures, the heteroatom being nitrogen. These heterocyclic structures are saturated prior to the removal of the heteroatom of nitrogen. Similarly, hydrodearomatisation involves the saturation of aromatic rings. Each of these reactions occur to a differing amount on each of the catalyst types as the catalyst are selective to favor one type of transfer over others and as the transfers are competing.

Figure 2:
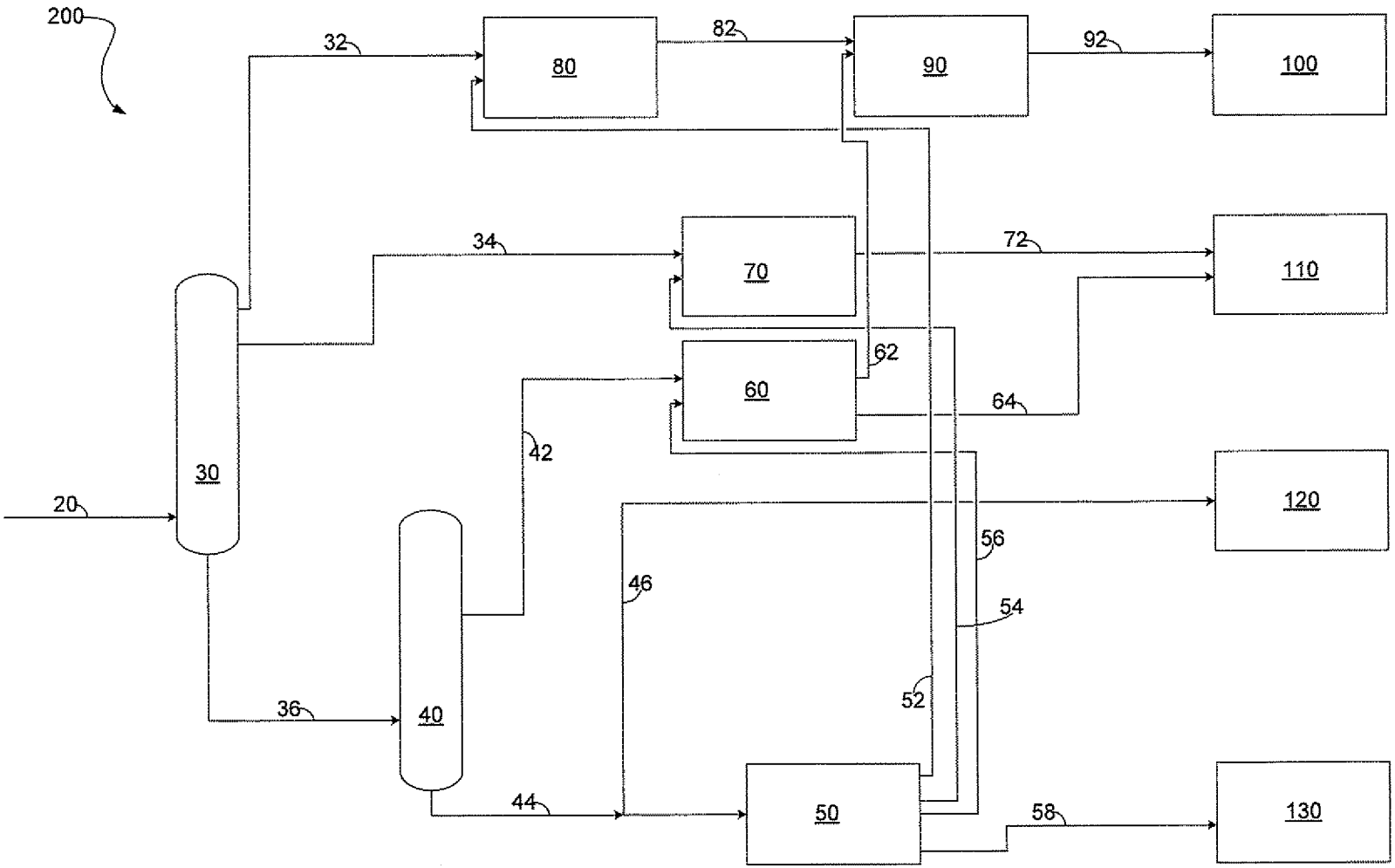
FIG. 2 shows a refining step in accordance with an embodiment of the present invention.
Figure 3:
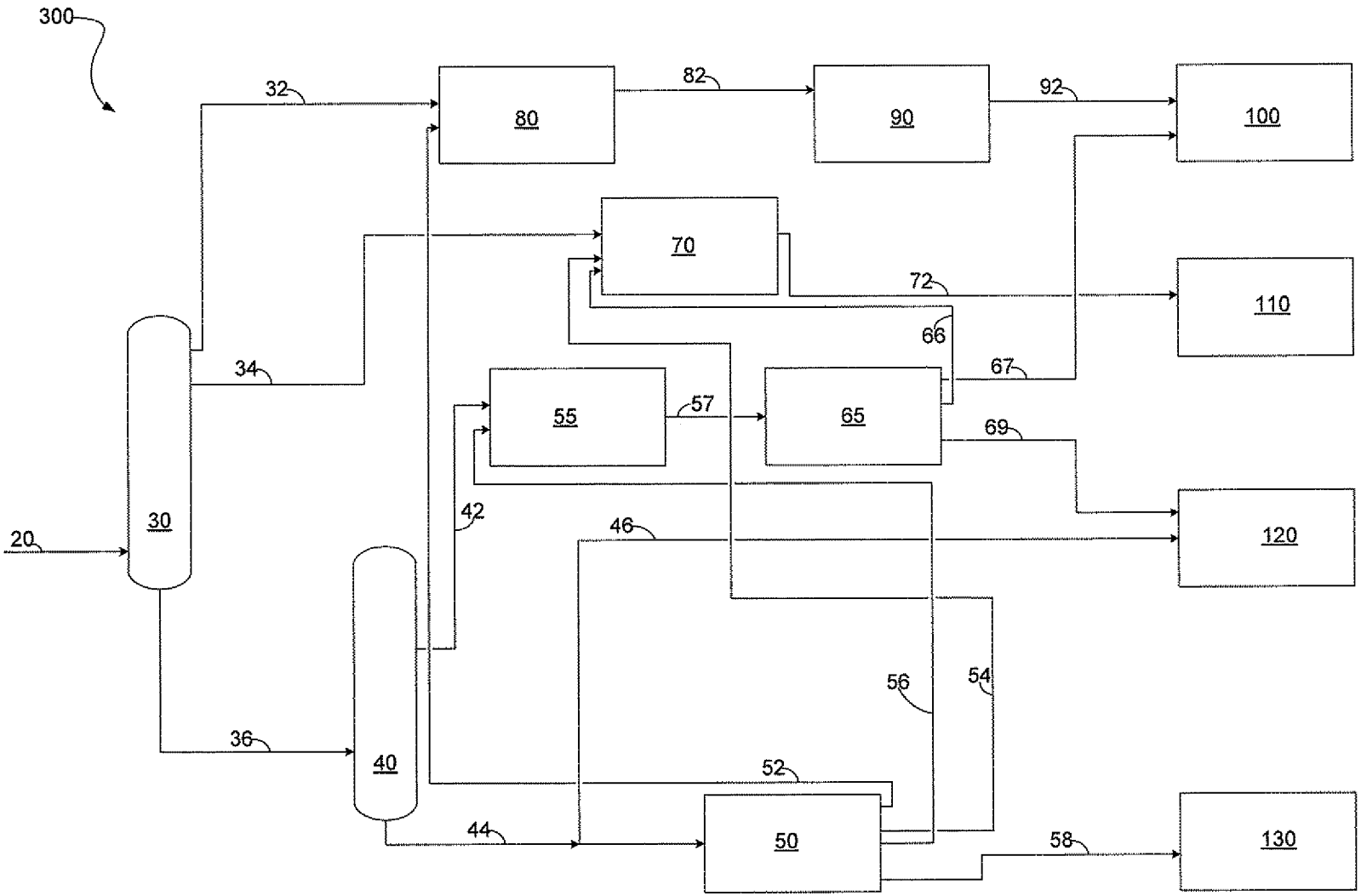
FIG. 3 shows a refining step in accordance with an embodiment of the present invention.

In embodiments of the present invention, sweetened crude oil (20) is used as a feedstock or as part of a feedstock for an existing refinery, such as a coking refinery with a hydrocracking process unit as shown in FIG. 2 or in a coking refinery with an FCC conversion unit as shown in FIG. 3. In the case of sweetened crude oil (20) being used as part of a feedstock, the balance of the feedstock can be crude not derived from the pretreatment step, an example being the virgin crude oil shown in Table I above. A simplified schematic of the typical coking refinery can be seen in FIG. 2.

FIG. 2 represents a first embodiment of a delayed coking facility (200) having a coking refinery with a hydrocracking process unit. In FIG. 2, sweetened crude oil (20), which can comprise either intermediate liquid product (15) or final liquid product (18) from FIG. 1, enters atmospheric distillation column (30), where it is separated into at least, but not limited to three fractions: straight run naptha (32), ATM gas oil (34), and atmospheric residue (36). Due to flash vessel (16) shown in FIG. 1 being optional, for purposes of this application, sweetened crude oil (20) encompasses both intermediate liquid product (15) and final liquid product (18) since either intermediate liquid product (15) or final liquid product (18) could act as a feedstream for the refineries shown in FIG. 2 and FIG. 3. In an additional embodiment, virgin crude oil can be added along with sweetened crude oil (20) as a feedstock for both FIG. 2 and FIG. 3.

Atmospheric residue (36) enters vacuum distillation column (40), wherein atmospheric residue (36) is separated into vacuum gas oil (42) and vacuum residue (44). In the embodiment shown in FIG. 2, slip stream (46) can be removed from vacuum residue stream (44) and sent to fuel oil collection tank (120). The remainder of vacuum residue (44) enters delayed coking process unit (50), wherein vacuum residue (44) is processed to create coker naphtha (52), coker gas oil (54), heavy coker oil (56), and green coke (58), with green coke (58) being then sent to coke collection tank (130). Green coke, as used herein, is another name for a higher quality coke. Coupled with the lower coke yield, a higher liquid yield will be observed resulting in higher amounts of coker gas oil (54) and heavy coker gas oil (56). Coker gas oil (54) in the present invention is fed to gas oil hydrotreater (70). Typically coker gas oil (54) is high in unsaturated content, particularly olefins, which can deactivate downstream hydrotreating catalyst. An increased yield of this stream would normally constrain gas oil hydrotreater (70) catalyst cycle length. However, in embodiments of the present invention, this increased feed to gas oil hydrotreater (70) can be processed due to the improved properties of ATM gas oil (34), 250° C.-350° C. being improved by the pretreatment step (e.g. lower sulfur and aromatics in the feed).

Coker gas oil (54) along with ATM gas oil (34) are sent to gas oil hydrotreater (70) in order to further remove impurities. Typically coker gas oil (54) and ATM gas oil (34) are high unsaturated content, particularly olefins which can deactivate downstream hydrotreating catalysts. An increased yield of these streams would normally constrain gas oil hydrotreater (70) catalyst cycle length. However, in accordance with an embodiment of the present invention, this increased feed to gas oil hydrotreater (70) can be processed due to the improved properties of ATM gas oil (34) and coker gas oil (54). Distillate fuels (72) leave gas oil hydrotreater (70) and are introduced into distillate fuel collection tank (110).

Coker naphtha (52), along with straight run naphtha (32), are sent to naphtha hydrotreater (80). Due to the fact that coker naphtha (52) and straight run naphtha (32) have lower amounts of sulfur than they would normally contain absent the pretreatment steps shown in FIG. 1, naphtha hydrotreater (80) will not have to perform as much hydrodesulfurization as it would normally require, which allows for increased throughputs and ultimately higher yields of gasoline fractions.

Another advantage of an embodiment of the present invention, which further enables the increase in throughput through delayed coking process unit (50), is the fact that ATM gas oil (34) is significantly lower in sulfur content. As shown in Table II, ATM gas oil (34) contains approximately 345 ppm when operated in accordance with embodiments of the present invention, whereas it would normally contain approximately 1.683 wt % using virgin crude oil as the feedstock for the refinery shown in FIG. 2. This means that for the refinery configuration shown, which would have been designed for an ATM gas oil (34) having a sulfur concentration of 1.683 wt %, a lower sulfur feed will mean that a higher throughput can be processed by gas oil hydrotreater (70) while still maintaining the same product quality. Additionally, and more applicable for the present invention, this additional capacity can be used to process the increased quantity of coker gas oil (54) from the higher throughput through delayed coking process unit (50).

The increased throughput possible through delayed coking process unit (50) enables the conventional refinery to be debottlenecked, which equates to about an extra 35% of throughput (e.g. can increase flow rate of sweetened crude oil (20)) through the represented refinery configuration. This is an example of one of the advantages realized by the pretreatment of the virgin crude oil prior to feeding to the described refinery configuration.

Vacuum gas oil (42) along with heavy coker gas oil (56) are sent to hydrocracker (60) for upgrading to form hydrocracked naphtha (62) and hydocracked middle distillate (64), with hydrocracked middle distillate (64) being fed, along with distillate fuels (72), to distillate fuel collection tank (110).

Hydrotreated naphtha (82) and hydrocracked naphtha (62) are introduced to naphtha reformer (90), wherein hydrotreated naphtha (82) and hydrocracked naphtha (62) are converted from low octane fuels into high-octane liquid products known as gasoline (92). Essentially, naphtha reformer (90) re-arranges or re-structures the hydrocarbon molecules in the naphtha feedstocks as well as breaking some of the molecules into smaller molecules. The overall effect is that the product reformate contains hydrocarbons with more complex molecular shapes having higher octane values than the hydrocarbons in the naphtha feedstocks. In so doing, the naphtha reformer (90) separates hydrogen atoms from the hydrocarbon molecules and produces very significant amounts of byproduct hydrogen gas for use as make-up hydrogen stream (14) of FIG. 1.

Conventionally, a traditional coking refinery would be limited in throughput by delayed coking process unit (50). The maximum throughput of the refinery would therefore also be limited by the maximum amount of throughput possible through delayed coking process unit (50). The present invention; however, advantageously includes the pre-treatment step to enable the processing of an increased amount of crude oil through the refinery with surprisingly improved results.

One example of the properties of a sweetened crude oil can be seen in Table II. This sweetened crude oil has been derived from treating Arab Heavy crude, but other such sweetened crude oil's are envisaged depending on the origin of the virgin crude oil. In one embodiment, the virgin crude oil is separated into seven different fractions. The first five fractions are in the fuel boiling range and are derived from fractionation by atmospheric distillation. The remaining fractions are vacuum gas oil (42) and vacuum residue (44). In the refinery flow scheme shown in FIG. 2, the vacuum residue (44) (540° C. plus stream) is directed to delayed coking process unit (50). From Table II it can be seen that when this feedstock is not pretreated, the metals (for instance Nickel and/or Vanadium) content of this stream is very high, 229 ppm (53.1+175.9). In addition, the sulfur content is 5.477 wt % and the Conradson carbon is 25.1 wt %. The design of delayed coking process unit (50) can be based upon these properties, which are typical for an untreated Arabian Heavy feedstock.

If, as in the case of the present invention, a treated crude oil is now processed in the same simplified refinery configuration as shown in FIG. 2, the reduction of sulfur, asphaltene content, Conradson carbon and nitrogen content will cause the performance of all the downstream process to be advantageously affected. The exemplary sweetened crude oil produced as part of the present invention has properties as shown in Table II. When taking the vacuum residue fraction into consideration (boiling point of ≧540° C.), it can clearly be seen that after treatment, a significant reduction of the main contaminants, most notably metals (Ni+V), occurs. In addition to this reduction of metal contaminant, the sulfur content has also been reduced from 5.48 wt % to 1.72 wt %, a reduction of approximately 69%, while the Conradson carbon is reduced from 25.1 wt % to 17.7 wt %, or approximately 29%. Reductions of a similar magnitude are seen for the asphaltene content from 24 to 15 wt %. Since this sweetened crude oil has a lower level of contaminants, use of the sweetened crude oil as a feedstock for subsequent refining processes like those shown in FIG. 2 or FIG. 3 results in lower quantities of coke production, which in turn allows for increased throughputs and higher overall liquid yields from the given refinery configuration.

In embodiments in which the sweetened crude oil is combined with untreated crude oil as a feedstock for subsequent refining processes (not shown), for example a delayed coking facility having a delayed coking process unit, the delayed coking process unit can run at essentially the same coke handling capacity it was designed for originally, but with improved yields in all of the liquid products and enhancement of the petroleum coke quality (lower sulfur and metals). One of the positive impacts that this would have on delayed coking process unit (50) would be that the feed stream will be lower in metals, carbon and sulfur, since the sweetened crude oil acts like a diluent. The impact of lower sulfur will mean that the final coke product will be of a higher grade, resulting in green coke (58).

In embodiments employing the use of the delayed coking process, one of the benefits of the present invention will be the increased volumetric flow through delayed coking process unit (50). In one embodiment, an extra 10% increase in the throughput through delayed coking process unit (50) can be achieved due to the sweetening pretreatment process. Due to the lower Conradson carbon content of sweetened crude oil (20), a lower yield of coke will be achieved. This lower yield of coke can be taken advantage of in many ways. For example, an increased on stream factor, i.e. longer coker cycles. The lower yield of coke can also mean that the operative coke drum (not shown) can accommodate a longer on-stream time to fill before it is taken offline, emptied and cleaned. Typically, once the cycle has finished, the coke is removed from the drums for regular cleaning and maintenance; however, embodiments of the present invention can increase the efficiency of this step, further increasing the on-stream factor of the coker.

A second refinery embodiment (300) having a coking refinery with an FCC conversion unit, which utilizes the same bottoms conversion but having different Vaccuum Gas Oil conversion can be seen in FIG. 3. In this embodiment, sweetened crude oil (20) is fed to this refinery just as in FIG. 2. In fact, the embodiments shown in FIG. 2 and FIG. 3 are highly similar except that they differ primarily in that FIG. 3 uses a combination of VGO hydrotreater (55) and FCC unit (65) in place of hydrocracker (60 FIG. 1). As was discussed for the process shown in FIG. 2, the pretreated processing of sweetened crude oil (20) will impact all of the process units within the refinery configuration of FIG. 3. Analogous benefits will be seen with delayed coking process unit (50) as for the previous example, namely the increased liquid yield and lower coke production. As discussed previously, this will enable a higher throughput through delayed coking process unit (50), enabling a higher throughput through the refinery. In addition, there will be an increased capacity for further processing coker gas oil (54) in gas oil hydrotreater (70), due to the lower sulfur content of coker gas oil (54) and its impact on the reduced HDS requirement from gas oil hydrotreater (70).

In addition, the sulfur content of straight run naphtha (32) will be lower in sulfur and will therefore require lower HDS in naphtha hydrotreater (80). This will enable naphtha hydrotreater (80) to process the resulting higher liquid yields of coker naphtha (52).

Vacuum gas oil feed (42) contains a significantly lower amount of sulfur following the pretreatment step carried out by the embodiment shown in FIG. 1. This means that the amount of desulfurization required by this feedstock is lower, thereby reducing operating temperatures for the catalyst within VGO hydrotreater (55). In fact, the actual demand from VGO hydrotreater (55) is reduced significantly, as VGO hydrotreater's (55) main purpose is to reduce the sulfur exposure for FCC unit (65) by producing desulfurized vacuum gas oil (57). Due to the anticipated higher liquid product yield from delayed coking process unit (50), a higher heavy coker gas oil (56) yield is expected. Due to the higher coking tendency of this product, it would normally be expected to reduce the lifetime of the catalyst in VGO hydrotreater (55). However, embodiments in accordance with the present invention provide a cleaner feedstock to VGO hydrotreater (55), thereby enabling co-processing of a more distressed stream such as heavy coker gasoil (56).

Desulfurized vacuum gas oil (57) is introduced to FCC unit (65), where it is hydrocracked to produce three streams: light cycle oil (66), FCC gasoline (67), and heavy cycle oil (69). Light cycle oil (66) is combined with ATM gas oil (34) and coker gas oil (54) in gas oil hydrotreater (70) to form distillate fuels (72). Heavy cycle oil (69) is combined with slipstream (46) at fuel oil collection tank (120). FCC gasoline (67) is joined by gasoline (92) at gasoline pool collection tank (100).

Having described the invention above, various modifications of the techniques, procedures, materials, and equipment will be apparent to those skilled in the art. While various embodiments have been shown and described, various modifications and substitutions may be made thereto. Accordingly, it is to be understood that the present invention has been described by way of illustration(s) and not limitation. It is intended that all such variations within the scope and spirit of the invention be included within the scope of the appended claims. The singular forms "a", "an" and "the" include plural referents, unless the context clearly dictates otherwise. By way of example, the term "a vessel" could include one or more vessels used for the stated purpose. Moreover, the present invention may suitably comprise, consist or consist essentially of the elements disclosed and may be practiced in the absence of an element not disclosed.

What is claimed is:

1. A process for improving throughputs of a refinery, wherein the process comprises the steps of:

introducing a virgin crude oil stream in the presence of hydrogen gas to an HDM reaction zone, wherein the virgin crude oil stream is at a process temperature between about 350 and about 450 degrees Celsius, the HDM reaction zone containing an HDM catalyst, the HDM catalyst being operable to remove a substantial quantity of metal compounds from the virgin crude oil stream resulting in a combined effluent stream;

removing the combined effluent stream from the HDM reaction zone;

introducing the combined effluent stream to a HDS reaction zone, the HDS reaction zone containing an HDS catalyst, the HDS catalyst being operable to remove a substantial quantity of sulfur components from the combined effluent stream resulting in an HDS effluent stream;

removing the HDS effluent stream from the HDS reaction zone;

feeding the HDS effluent stream to a separation unit, the separation unit operable to separate the HDS effluent stream into a process gas component stream and an intermediate liquid product, wherein the intermediate liquid product contains reduced amounts of sulfur, metals, and Conradson carbon as compared to the virgin crude oil stream, wherein the intermediate liquid product has an increased API gravity as compared to the virgin crude oil stream;

recycling at least a portion of the process gas component stream to the HDM reaction zone; and introducing the intermediate liquid product from the separation unit into a delayed coking facility, a final liquid product is produced from the intermediate liquid product, such that the final product has an increased diesel content as compared to the virgin crude oil stream, wherein the delayed coking facility's throughput has at least a 10 percent increase when using the intermediate liquid product as opposed to the virgin crude oil stream.

2. The process of claim 1,wherein the HDM catalyst comprises a gamma alumina support, wherein the HDM catalyst has a surface area of approximately 100-160 $m^2/g$ and a pore volume of at least 0.8 $cm^3/g$.

3. The process of claim 1, wherein the HDM catalyst comprises nickel and molybdenum, wherein the nickel to molybdenum mole ratio is 0.15.

4. The process of claim 1, wherein the HDM catalyst comprises a sulfide of a metal selected from the group consisting of Groups Va, VIa, VIII of the periodic table, and combinations thereof.

5. The process of claim 4, wherein the HDM catalyst further comprises a dopant, wherein the dopant is selected from the group consisting of boron, silicon, halogens, phosphorus, and combinations thereof.

6. The process of claim 1, wherein the HDS catalyst comprises a gamma alumina support, wherein the HDM catalyst has a surface area of approximately 200-280 $m^2/g$, and a pore volume of less than 1.0 $cm^3/g$.

7. The process of claim 1, wherein the HDS catalyst comprises nickel and molybdenum, wherein the nickel to molybdenum mole ratio is within a range of 0.1 to 0.3.

8. The process of claim 1, wherein the HDS catalyst comprises cobalt, nickel and molybdenum, wherein a mole ratio of (cobalt+nickel)/molybdenum is within a range of 0.25 to 0.85.

9. The process of claim 1, whereby the HDM catalyst includes a sulfide of a metal selected from groups Va, VIa and VIII of the periodic table.

10. The method of claim 1 whereby the HDS catalyst includes a sulfide of a metal selected from groups Va, VIa and VIII of the periodic table.

11. The process of claim 1, wherein the intermediate liquid product has a 30% by weight reduction in the amount of sulfur content as compared to the virgin crude oil stream.

12. The process of claim 1, wherein the API gravity of the intermediate liquid product is at least one degree higher than the API gravity of the virgin crude oil stream.

13. The process of claim 1, wherein the intermediate liquid product has 3% by weight reduction in asphaltene content as compared to the virgin crude oil stream.

14. The process of claim 1, further comprising introducing the HDS effluent stream to an HDC reaction zone prior to feeding the HDS effluent stream to the separation unit, the HDC reaction zone containing an HDC catalyst, the HDC catalyst being operable to crack the HDS effluent stream resulting in a cracked HDS effluent stream, the cracked HDS effluent stream being characterized as having an increased API gravity of at least 1° greater than the virgin crude oil stream and a reduced amount of metal and sulfur content as compared to the virgin crude oil stream.

* * * * *